US007793632B2

(12) United States Patent
Idogawa et al.

(10) Patent No.: US 7,793,632 B2
(45) Date of Patent: Sep. 14, 2010

(54) IGNITION APPARATUS FOR AN INTERNAL COMBUSTION ENGINE

(75) Inventors: Takashi Idogawa, Chiyoda-ku (JP); Shigemi Murata, Chiyoda-ku (JP); Takeshi Shimizu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/212,790

(22) Filed: Sep. 18, 2008

(65) Prior Publication Data

US 2009/0314239 A1 Dec. 24, 2009

(30) Foreign Application Priority Data

Jun. 20, 2008 (JP) ..... 2008-161974

(51) Int. Cl.
*H01T 13/08* (2006.01)

(52) U.S. Cl. ..... 123/169 R; 123/143 B; 123/169 PA; 315/39.63

(58) Field of Classification Search ..... 123/169 R, 123/169 PA, 169 EL, 143 B, 143 R, 145 R, 123/148 P, 536, 606, 615, 620, 627, 640; 313/134, 118, 141; 315/39, 39.63; 73/114.29
See application file for complete search history.

(56) References Cited

U.S. PATENT DOCUMENTS 3,589,177 A * 6/1971 Merlo ..... 73/114.29
3,934,566 A * 1/1976 Ward ..... 123/275
4,403,504 A * 9/1983 Krage et al. ..... 73/114.29
4,437,338 A * 3/1984 Wilson ..... 73/114.29
5,254,237 A * 10/1993 Snaper et al. ..... 204/298.41
6,357,426 B1 3/2002 Schleupen
6,838,831 B2 * 1/2005 Brandenburg et al. .. 315/111.21

FOREIGN PATENT DOCUMENTS

JP 2002-530572 A 9/2002
JP 2007-113570 A 5/2007
JP 2007-311684 A 11/2007
JP 2008-103636 A 5/2008

* cited by examiner

*Primary Examiner*—Stephen K Cronin
*Assistant Examiner*—Johnny H Hoang
(74) *Attorney, Agent, or Firm*—Sughrue Mion, PLLC

(57) ABSTRACT

An ignition apparatus for an internal combustion engine is small in size and has high reliability capable of withstanding or enduring a vibration environment of a vehicle to which the ignition apparatus is installed. The ignition apparatus includes a spark plug that has its tip end portion presented in the interior of a cylinder of an internal combustion engine main body, a high voltage generation power supply that serves to apply a high voltage to the spark plug, a microwave oscillation device that has an amplifying element for generating a microwave, and a microwave antenna that is mounted on the spark plug, irradiates the micro wave generated from the microwave oscillation device to the interior of the cylinder, thereby forming a plasma generation region around discharge electrodes of the spark plug. The microwave oscillation device is made into a solid state.

11 Claims, 4 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine in which a plasma generation region is formed around discharge electrodes of a spark plug.

2. Description of the Related Art

In the past, there has been known an ignition apparatus for an internal combustion engine which includes spark plugs each of which has its tip end portion presented in the interior of a corresponding cylinder of an internal combustion engine main body, a high voltage generation power supply that serves to apply a high voltage to the spark plugs, a magnetron that generates a microwave, and a microwave antenna that is mounted on each of the spark plugs, irradiates the microwave generated from the magnetron to the interior of a corresponding cylinder, thereby forming a plasma generation region around discharge electrodes of the spark plug (see, for example, a first patent document: Japanese patent application laid-open No. 2007-113570).

In this ignition apparatus, by irradiating a microwave to a mixture containing air and fuel mixed therein, the time of combustion of the fuel can be shortened to improve the combustion efficiency, thus making it possible to reduce the rate or amount of fuel consumed.

However, in the microwave oscillation device as described above, the magnetron is used which is a thermionic tube generally used for consumer products such as microwave ovens or the like.

The principle of operation of the magnetron is that when a magnetic field due to a magnet is applied to electrons coming out from a heated cathode filament to an anode or positive terminal, a Lorentz force is applied to the electrons to curve their trajectory, whereby the electrons thus curved resonate in a small chamber of the anode, which serves as a cavity resonator, thereby generating a microwave in a continuous manner.

However, in "International Telecommunication Union (ITU)", the assignment of operation frequencies is defined in order to avoid electrical or radio interference and noise jamming between individual applications and uses. Industrial, Scientific and Medical (ISM) Use bands are designated for "dielectric heating", and a frequency of 2,450 MHz is approved and allocated for microwave ovens according to the Radio Law in Japan.

Since in magnetrons for microwave ovens, the dimensions of an anode or positive terminal is set according to this approved microwave frequency, there is little or no room for reducing the sizes of magnetrons as a whole. Thus, the entire volume of each magnetron becomes about 10 cm (width)× about 10 cm (depth)×about 20 cm (height).

Accordingly, in an internal combustion engine main body composed of a plurality of cylinders, it is necessary to provide a magnetron for each cylinder that requires a large space for installation thereof, and hence there has been a problem that in actuality, it is difficult to install a plurality of such magnetrons on the internal combustion engine main body.

In addition, in case where such an ignition apparatus is installed on a vehicle, there has been another problem that it is difficult for the magnetrons of large weights to withstand or endure vibrations applied thereto.

SUMMARY OF THE INVENTION

In view of the above, the present invention is intended to obviate the problems as referred to above, and has for its object to provide an ignition apparatus for an internal combustion engine which is small in size and has high reliability capable of withstanding or enduring a vibration environment of a vehicle on which the ignition apparatus is installed.

Bearing the above object in mind, an ignition apparatus for an internal combustion engine according to the present invention includes: a spark plug that has its tip end portion presented in the interior of a cylinder of an internal combustion engine main body; a high voltage generation power supply that serves to apply a high voltage to the spark plug; a microwave oscillation device that has an amplifying element for generating a microwave; and a microwave antenna that is mounted on the spark plug, irradiates the micro wave generated from the microwave oscillation device to the interior of the cylinder, thereby forming a plasma generation region around discharge electrodes of the spark plug. The microwave oscillation device is made into a solid state.

According to the ignition apparatus for an internal combustion engine of the present invention, the microwave oscillation device is made into a solid state or is formed of solid state components, so there is obtained an advantageous effect that the microwave oscillation device is able to withstand or endure a vibration environment of a vehicle.

The above and other objects, features and advantages of the present invention will become more readily apparent to those skilled in the art from the following detailed description of preferred embodiments of the present invention taken in conjunction with the accompanying drawings.

DETAILED DESCRIPTION OF THE PREFERRED EMBODIMENTS

Figure 1:
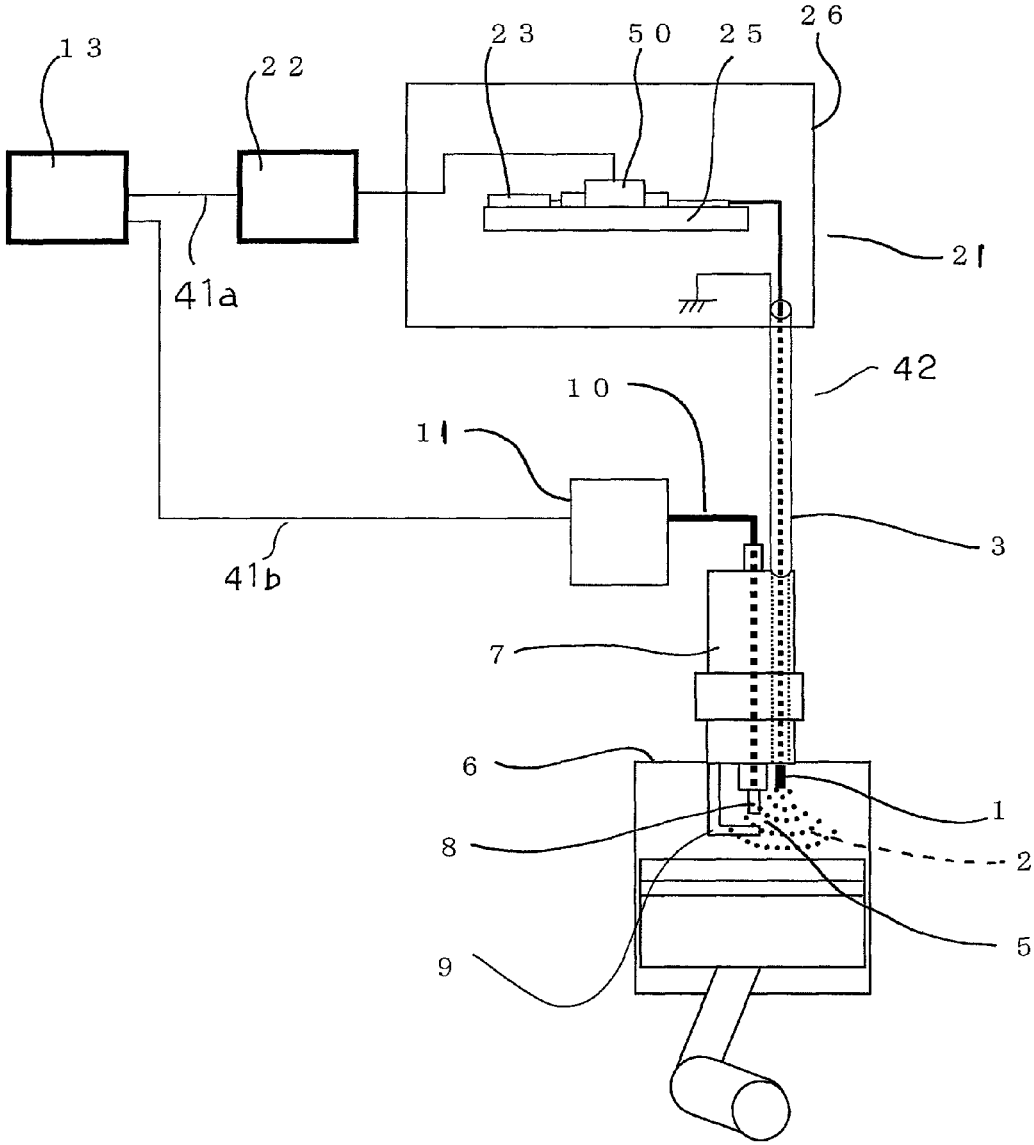
FIG. 1 is a block diagram showing an ignition apparatus for an internal combustion engine according to a first embodiment of the present invention.

Now, preferred embodiments of the present invention will be described in detail while referring to the accompanying drawings. Throughout individual figures, the same or corresponding members or parts are identified by the same reference numerals and characters.

Embodiment 1

Figure 2:
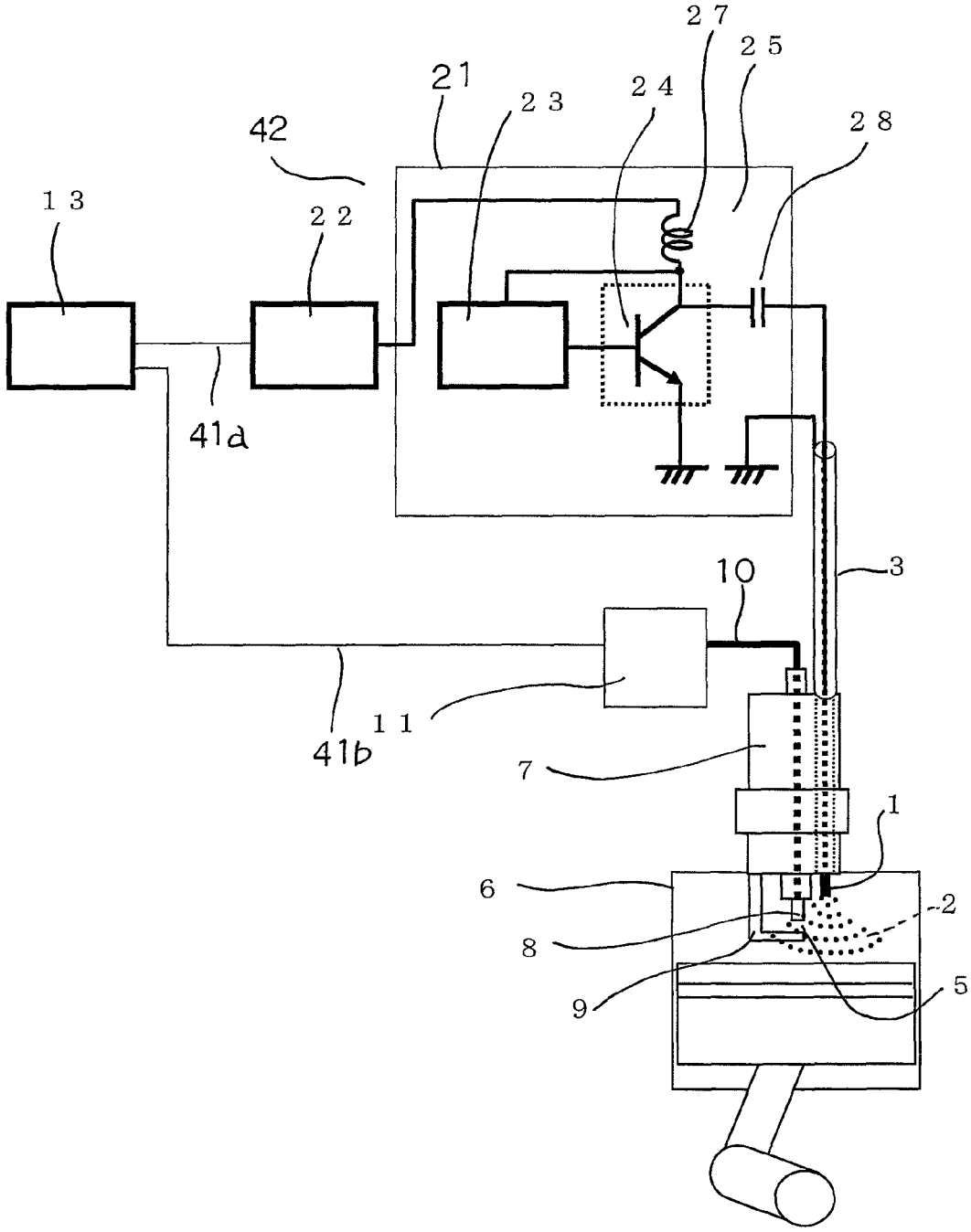
FIG. 2 is an electric circuit diagram of a microwave oscillation device shown in FIG. 1.

Referring to the drawings and first to FIG. 1, there is shown a block diagram of an ignition apparatus 42 for an internal combustion engine (hereinafter abbreviated as an ignition apparatus) according to a first embodiment of the present invention. FIG. 2 is an electric circuit diagram of a microwave oscillation device 21 shown in FIG. 1.

This ignition apparatus 42 is provided for each of cylinders 6, and includes a spark plug 7 having an ignition and discharge part 5, a high voltage generation power supply 11 that is connected to the ignition and discharge part 5 through a connection cable 10, a control unit 13 that is electrically connected the high voltage generation power supply 11 through a control unit line 41*b*, a microwave antenna 1 that is arranged in the vicinity of the ignition and discharge part 5 and irradiates a microwave thereby to form a plasma generation region 2, a microwave oscillation device 21 that is electrically connected to the microwave antenna 1 through a coaxial cable 3, an oscillator power supply 22 that is electrically connected to the microwave oscillation device 21, and the above-mentioned control unit 13 that is electrically connected to the oscillator power supply 22 through a control unit line 41*a*.

The ignition and discharge part 5 has a center discharge electrode 8 that is arranged in a ceiling space of a corresponding cylinder 6 and is located in the plasma generation region 2, and an L-shaped side discharge electrode 9 that is arranged at one side of the center discharge electrode 8.

The microwave oscillation device 21 is made into a solid state, and includes a substrate 25 of a several centimeter square made of alumina or the like, a resonator 23 with its conductor printed on the substrate 25, an amplifier circuit 50 having a choke coil 27, a coupling capacitor 28, and an amplifying element 24 of a height of about a few millimeters, and a casing 26 which receives therein the substrate 25, the resonator 23 and the amplifier circuit 50, and serves to shield microwaves.

The microwave oscillation device 21 takes the form of a small box as a whole, in which the substrate 25 has a rear surface bonded to a bottom surface of the casing 26 by means of a bonding or adhesive material. Specifically, the amplifying element 24 is in the form of a transistor made of silicon (Si). The choke coil 27 is an element that serves to supply electric power to the amplifying element 24 and to interrupt an alternating current component to the oscillator power supply 22.

Now, the operation of the ignition apparatus as constructed above will be explained below.

First of all, when a cylinder 6 with a combustion gas of an air fuel mixture filled therein is to be ignited, a predetermined actuation signal is provided from the control unit 13 to the high voltage generation power supply 11 and the oscillator power supply 22. The oscillator power supply 22 is driven by the actuation signal, so that electric power is supplied to the amplifying element 24 of the microwave oscillation device 21.

The microwave oscillation device 21 is driven to oscillate at the frequency of the resonator 23 while applying a positive feedback by means of the resonator 23 and the amplifying element 24. An oscillating output of the microwave oscillation device 21 is supplied to the microwave antenna 1 through the coupling capacitor 28 and the coaxial cable 3.

A microwave is transmitted or irradiated from the microwave antenna 1, whereby a low temperature plasma is generated in the plasma generation region 2 around the ignition and discharge part 5. A large amount of OH radicals can be continuously produced from moisture in the air fuel mixture due to the generation of this low temperature plasma.

A high voltage, which is generated in a secondary side of a transformer (not shown) under such an atmosphere by the turning-off operation of a switching element (not shown) of the high voltage generation power supply 11, is supplied to the ignition and discharge part 5, whereby a spark discharge is generated between the center discharge electrode 8 and the side discharge electrode 9. With this spark discharge as a starting point, the OH radicals having been previously produced serve to facilitate the combustion of the mixture.

Here, note that the electric circuit diagram of FIG. 2 showing the microwave oscillation device 21 is just one example, and other electric circuits can of course be used as long as they are able to oscillate a microwave.

According to the ignition apparatus 42 of this first embodiment, the microwave oscillation device 21 is made into a solid state, i.e., is composed of solid-state components, so the size or dimensions thereof can be reduced to a substantial extent in comparison with a magnetron, and at the same time the weight thereof can be made lighter to a great extent. As a result, it is possible to install the ignition apparatus 42 on the main body of an internal combustion engine in a vehicle, and it is also possible to improve the vibration resistance of the ignition apparatus 42 to the vibration environment of the vehicle to a great extent.

In addition, with the microwave oscillation device 21, the microwave generated therein can be prevented from leaking to the outside by means of the casing 26.

Embodiment 2

Figure 3:
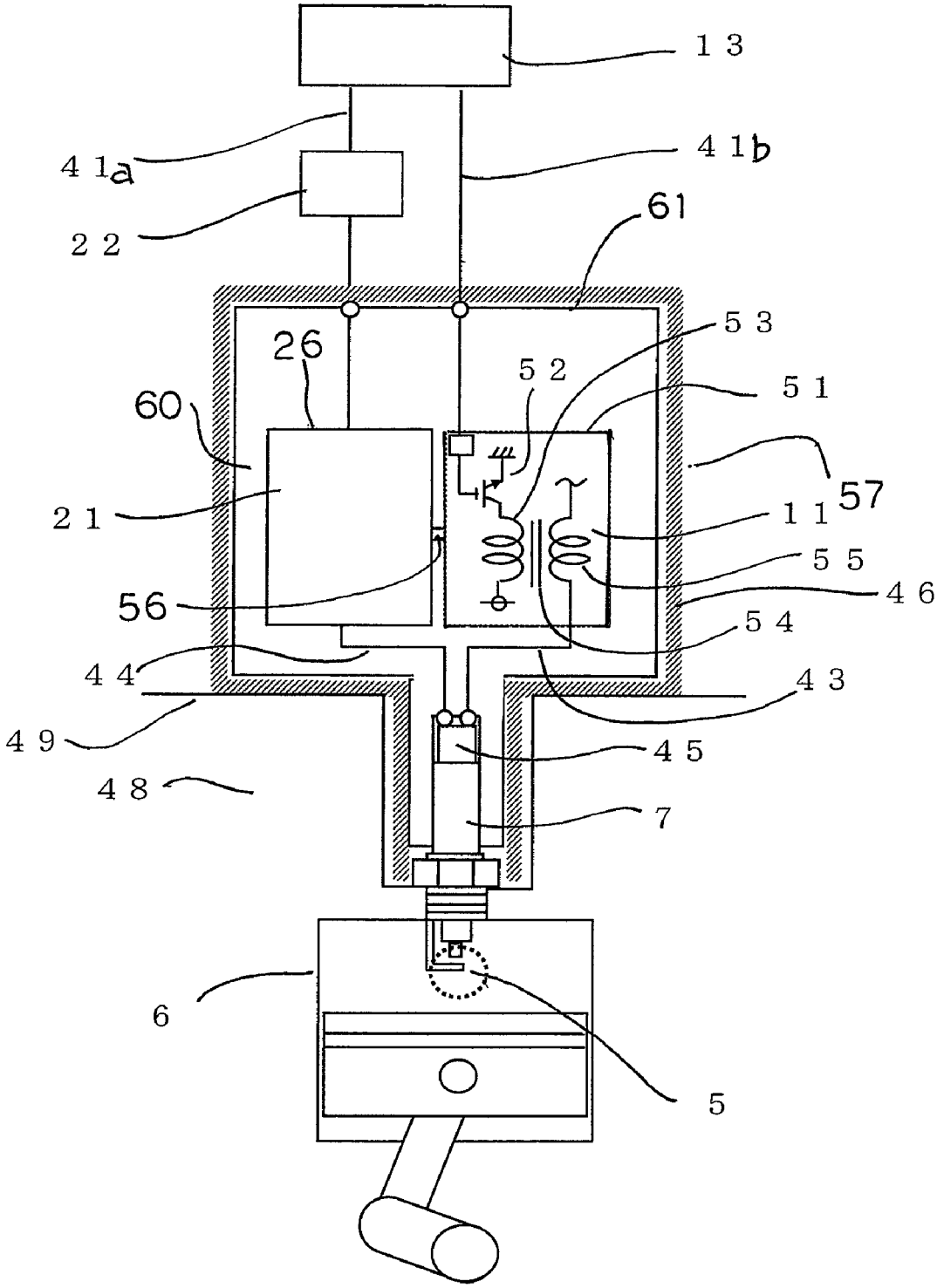
FIG. 3 is a cross sectional view showing an ignition apparatus for an internal combustion engine according to a second embodiment of the present invention.

FIG. 3 is a block diagram of an ignition apparatus for an internal combustion engine according to a second embodiment of the present invention.

In this second embodiment, a high voltage generation power supply 11 has a control circuit part 52, a primary coil 53, a iron core 54, and a secondary coil 55 received in a container 51. By the use of a coupling member 56, this high voltage generation power supply 11 is integrally coupled with a microwave oscillation device 21 in which a substrate 25, a resonator 23, and an amplifier circuit 50 are received in a casing 26. The high voltage generation power supply 11 and the microwave oscillation device 21 thus integrally coupled with each other cooperate to constitute a power supply and oscillation main body 60. This power supply and oscillation main body 60 with a portion of a spark plug 7 exposed from a cylinder 6 is covered with a microwave shield member 46 through an outer frame casing 61.

The high voltage generation power supply 11 is connected through a high voltage output line 43 to a spark plug terminal 45 of the spark plug 7. In addition, the microwave oscillation device 21 is connected through a microwave output line 44 to the spark plug terminal 45 of the spark plug 7.

In the high voltage generation power supply 11, a primary current in the primary coil 53 is interrupted by the operation of the control circuit part 52 in accordance with the ignition timing of the internal combustion engine, whereby a high voltage is generated in the secondary coil 55. As a result, a high-voltage current thus generated in the secondary coil 55 is sent to the spark plug 7 through the high voltage output line 43.

In addition, similar to the above-mentioned first embodiment, the oscillating output generated in the microwave oscillation device 21 is supplied to the microwave antenna 1 through the microwave output line 44.

The other construction of this second embodiment including the microwave oscillation device 21 is similar to that of the first embodiment.

Here, note that the casing 26 and the container 51 can be omitted, and the outer frame casing 61 can be made to serve as the casing 26 of the microwave oscillation device 21 and the container 51 of the high voltage generation power supply 11, and the high voltage generation power supply 11 and the microwave oscillation device 21 can be made integral with each other.

In addition, the coupling member 56, the casing 26, the container 51, and the outer frame casing 61 need only be made of resin materials or metal materials such as aluminum.

Figure 4:
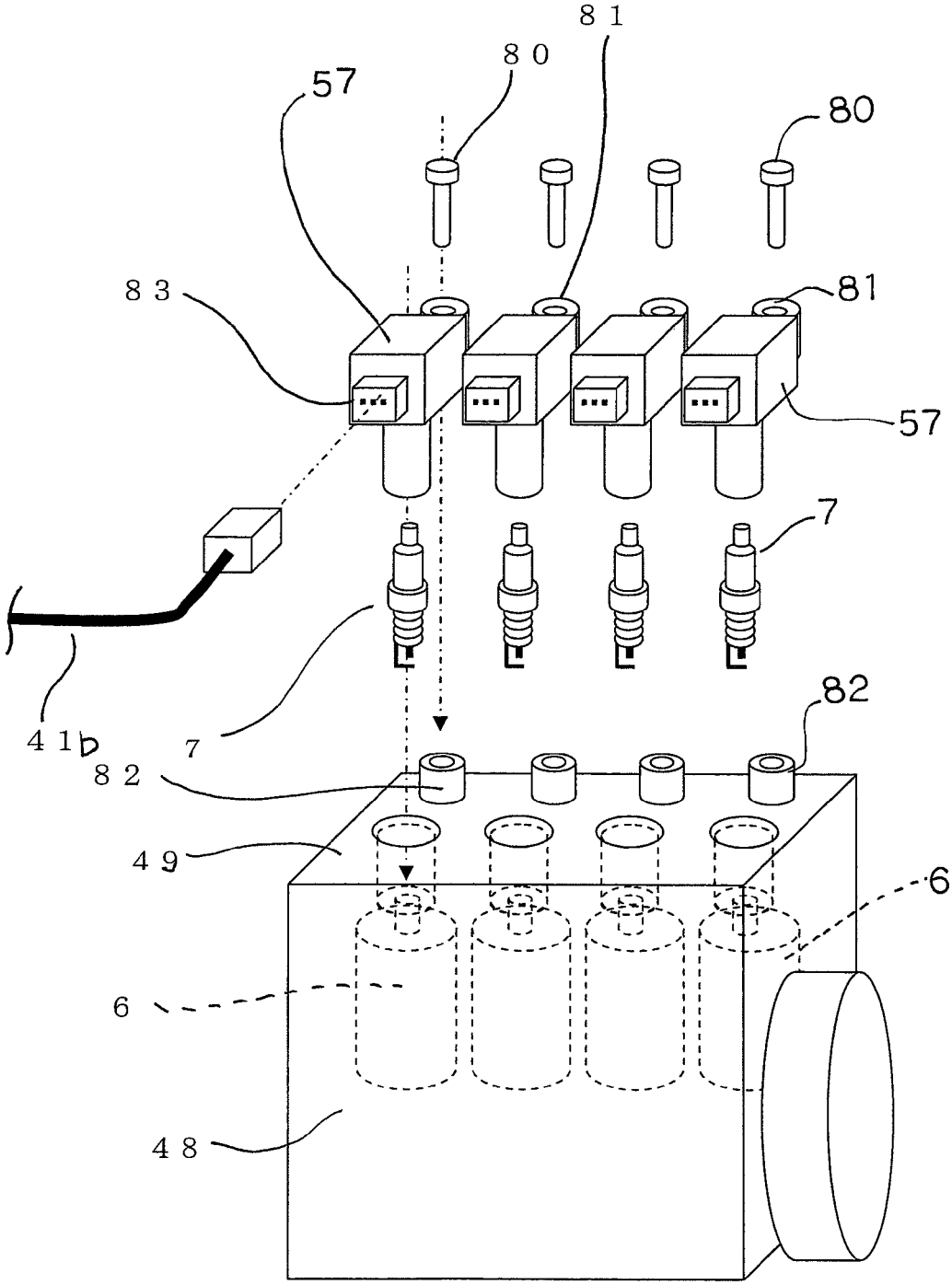
FIG. 4 is a perspective view showing an example in which the ignition apparatus for an internal combustion engine of FIG. 2 is installed on an internal combustion engine main body.

FIG. 4 is a perspective view showing an example in which a main body 57 of an ignition apparatus 42 excluding a control unit 13 and an oscillator power supply 22 is installed on a main body 48 of an internal combustion engine. In this example, the internal combustion engine is a four-cylinder engine in which individual ignition apparatus main bodies 57 are directly mounted on individual cylinders 6, respectively.

Each of the ignition apparatus main bodies 57 has a mounting flange 81 formed at a side thereof opposite to a connector 83. The internal combustion engine main body 48 has a plurality of mounting bosses 82 formed thereon in opposition to the mounting flanges 81 of the corresponding ignition apparatus main bodies 57, respectively. The ignition apparatus main bodies 57 are fixedly secured to the internal combustion engine main body 48 by inserting mounting bolts 80 into and through the corresponding mounting flanges 81, respectively, and putting them into threaded engagement with the corresponding mounting bosses 82, respectively.

According to the ignition apparatus 42 of this second embodiment, the same advantageous effects as those of the first embodiment can be achieved, and at the same time, the high voltage generation power supply 11 and the microwave oscillation device 21 are integrally formed with each other by means of the coupling member 56, so the number of man hours required for assembling the ignition apparatus 42 can be decreased, thus making it possible to reduce the production cost thereof.

In addition, since the power supply and oscillation main body 60 is covered with the microwave shield member 46, it is possible to prevent the microwave generated therein from leaking to the outside in a more reliable manner.

Moreover, the microwave shield member 46 also serves to cover or enclose the portion of the spark plug 7 exposed from the internal combustion engine main body 48, whereby the leakage of the microwave from the spark plug terminal 45 can be shielded in a reliable manner.

Further, the ignition apparatus main body 57 is formed into a single unit, so it is possible to abolish or omit the coaxial cable 3 of the first embodiment, which, if broken or damaged by the vibration environment of the vehicle, might allow leakage of a microwave therethrough. As a result, the reliability of the ignition apparatus 42 can be improved.

Furthermore, the loss of a microwave due to the coaxial cable 3 of a large length can be eliminated, and even if the output of the microwave oscillation device 21 is decreased, it can be ensured that a microwave is output or transmitted from the microwave antenna 1, whereby the power consumption of the vehicle can be decreased, thereby making it possible to serve for cost reduction.

Similarly, the connection cable 10 of the first embodiment with the possibility of being broken or damaged by the vibration environment of the vehicle can also be made unnecessary.

In the above-mentioned first and second embodiments, the transistor made of silicon (Si) is used as the amplifying element 24, but an amplifying element in the form of a transistor using gallium arsenide (GaAs) may instead be employed.

In the case of using such an amplifying element, a microwave oscillation device can be obtained which operates at higher speed, consumes less electric power, and is easier to reduce its size, than the transistor made of silicon (Si), and which is high in reliability and small in size so that it can be distributedly mounted on each cylinder.

In addition, a nitride semiconductor device made of gallium nitride (GaN) has a bandgap of 3.45 eV (corresponding to about 365 nm in the wavelength of light), and hence has a characteristic which is three times as wide as that of a silicon semiconductor device. Therefore, when applied to a transistor, the nitride semiconductor device has various features that it has a high withstand voltage, operates at high temperatures, can have an increased electric current density, is fast in switching, and is small in on-resistance.

Accordingly, by using the transistor made of gallium nitride (GaN) as the amplifying element 24 of the microwave oscillation device 21, it is possible to obtain a highly reliable and small-sized microwave oscillation device which can generate a higher output and can be distributedly mounted on each cylinder.

Moreover, by using, as a semiconductor material, aluminum gallium nitride (AlGaN) which has a bandgap of about 5 eV much wider than that of gallium nitride (GaN), the withstand voltage (dielectric breakdown voltage) of the amplifying element 24 can be improved several times as high as that of gallium nitride (GaN), thus making it possible to obtain a highly reliable and small-sized microwave oscillation device which can generate a much higher output and can be distributedly mounted on each cylinder.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a spark plug that has a tip end portion presented in an interior of a cylinder of an internal combustion engine main body;

a high voltage generation power supply that is electrically coupled to the tip end portion via a first electrical path and serves to apply a high voltage to said tip end portion of the spark plug;

a microwave oscillation device that has an amplifying element for generating a microwave; and a microwave antenna that is mounted on said spark plug, electrically coupled to the microwave oscillation device via a second electrical path, different from the first electrical path, which irradiates said microwave generated from said microwave oscillation device to the interior of said cylinder, thereby forming a plasma generation region around discharge electrodes of said spark plug;

wherein said microwave oscillation device is a solid state device.

2. The ignition apparatus for an internal combustion engine as set forth in claim 1, further comprising:

a power supply and oscillation main body that has said high voltage generation power supply and said microwave oscillation device formed integrally with each other.

3. The ignition apparatus for an internal combustion engine as set forth in claim 2, wherein said power supply and oscillation main body is directly connected to said spark plug.

4. The ignition apparatus for an internal combustion engine as set forth in claim 2, wherein said power supply and oscillation main body is covered with a microwave shield member that serves to shield said microwave.

5. The ignition apparatus for an internal combustion engine as set forth in claim 4, wherein said microwave shield member serves to cover a portion of said spark plug exposed from said internal combustion engine main body.

6. The ignition apparatus for an internal combustion engine as set forth in claim 1, wherein said amplifying element is a transistor made of silicon.

7. The ignition apparatus for an internal combustion engine as set forth in claim 1, wherein said amplifying element is a transistor made of gallium arsenide.

8. The ignition apparatus for an internal combustion engine as set forth in claim 1, wherein said amplifying element is a transistor made of gallium nitride.

9. The ignition apparatus for an internal combustion engine as set forth in claim 1, wherein said amplifying element is a transistor made of aluminum gallium nitride.

10. The ignition apparatus for an internal combustion engine as set forth in claim 1, wherein the tip end portion of the spark plug is electrically coupled to the high voltage generation power supply via a connection cable and the solid state microwave oscillation device is coupled to the microwave antenna via a coaxial cable which is different from the connection cable.

11. The ignition apparatus for an internal combustion engine as set forth in claim 1, wherein the solid state microwave oscillation device further includes:

a resonator coupled between an oscillation power supply and the amplifying element; and a capacitor coupled between the amplifying element and the microwave antenna.

* * * * *